United States Patent [19]

Schuller

[11] Patent Number: 4,462,512

[45] Date of Patent: Jul. 31, 1984

[54] CHANGE MAKING SYSTEM

[75] Inventor: James T. Schuller, St. Louis, Mo.

[73] Assignee: UMC Industries, Inc., Stamford, Conn.

[21] Appl. No.: 422,959

[22] Filed: Sep. 24, 1982

[51] Int. Cl.[3] ..... G07F 9/08

[52] U.S. Cl. ..... 194/1 N; 194/DIG. 14

[58] Field of Search ..... 377/13; 364/479; 340/825.35, 825.54; 194/1 N, 10, DIG. 14, 13; 235/381, 385; 346/33 A, 33 B; 133/2

[56] References Cited

U.S. PATENT DOCUMENTS 4,306,219 12/1981 Main et al. ..... 340/825.54

4,381,835 5/1983 Shah et al. ..... 194/1 N

*Primary Examiner*—Stanley H. Tollberg

*Attorney, Agent, or Firm*—Senniger, Powers, Leavitt and Roedel

[57] ABSTRACT

A change making system having circuitry for sensing the availability of coins for making change in at least two change tubes containing coins of different denominations, the coin tubes being part of a money handler in a vendor. A memory has stored therein, for each of a number of coin availabilities, a plurality of coin combinations equalling various amounts of change. A microprocessor determines the amount of change due the customer and retrieves from memory a coin combination, if any, stored therein which corresponds to the amount of change due and the particular availability of coins in the change tubes. If there is such a combination, it allows the vend. A method of the change making system is also disclosed.

14 Claims, 14 Drawing Figures

FIG. 10

| AMOUNT OF CHANGE DUE | 95¢ | 90¢ | 85¢ | 80¢ | 75¢ |
|---|---|---|---|---|---|
| AVAILABLE COINS | COIN COMBINATION | COIN COMBINATION | COIN COMBINATION | COIN COMBINATION | COIN COMBINATION |
| NICKELS, DIMES AND QUARTERS | 3Q-2D | 3Q-1D-1N | 3Q-1D | 3Q-1N | 3Q |
| NICKELS & DIMES | 9D-1N | 9D | 8D-1N | 8D | 7D-1N |
| NICKELS & QUARTERS | 3Q-4N | 3Q-3N | 3Q-2N | 3Q-1N | 3Q |
| NICKELS ONLY | | | | | |
| DIMES & QUARTERS | 3Q-2D | 2Q-4D | 3Q-1D | 2Q-3D | 3Q |
| DIMES ONLY | | | | | |
| QUARTERS ONLY | | | | | 3Q |
| NO COINS | | | | | |

| AMOUNT OF CHANGE DUE | 45¢ | 40¢ | 35¢ | 30¢ | 25¢ |
|---|---|---|---|---|---|
| AVAILABLE COINS | COIN COMBINATION | COIN COMBINATION | COIN COMBINATION | COIN COMBINATION | COIN COMBINATION |
| NICKELS, DIMES AND QUARTERS | 1Q-2D | 1Q-1D-1N | 1Q-1D | 1Q-1N | 1Q |
| NICKELS & DIMES | 4D-1N | 4D | 3D-1N | 3D | 2D-1N |
| NICKELS & QUARTERS | 1Q-4N | 1Q-3N | 1Q-2N | 1Q-1N | 1Q |
| NICKELS ONLY | 9N | 8N | 7N | 6N | 5N |
| DIMES & QUARTERS | 1Q-2D | 4D | 1Q-1D | 3D | 1Q |
| DIMES ONLY | | 4D | | 3D | |
| QUARTERS ONLY | | | | | 1Q |
| NO COINS | | | | | |

FIG.10A

| 70¢ | 65¢ | 60¢ | 55¢ | 50¢ |
|---|---|---|---|---|
| COIN COMBINATION | COIN COMBINATION | COIN COMBINATION | COIN COMBINATION | COIN COMBINATION |
| 2Q-2D | 2Q-1D-1N | 2Q-1D | 2Q-1N | 2Q |
| 7D | 6D-1N | 6D | 5D-1N | 5D |
| 2Q-4N | 2Q-3N | 2Q-2N | 2Q-1N | 2Q |
| | | | | |
| 2Q-2D | 1Q-4D | 2Q-1D | 1Q-3D | 2Q |
| 7D | | 6D | | 5D |
| | | | | 2Q |
| | | | | |

| 20¢ | 15¢ | 10¢ | 5¢ | $1.00 |
|---|---|---|---|---|
| COIN COMBINATION | COIN COMBINATION | COIN COMBINATION | COIN COMBINATION | COIN COMBINATION |
| 2D | 1D-1N | 1D | 1N | |
| 2D | 1D-1N | 1D | 1N | |
| 4N | 3N | 2N | 1N | |
| 4N | 3N | 2N | 1N | |
| 2D | | 1D | | |
| 2D | | 1D | | |
| | | | | |
| | | | | |

CHANGE MAKING SYSTEM

BACKGROUND OF THE INVENTION

This invention relates to change making and more particularly to a change making system for a money handler in a vendor.

Conventional coin handling and change making systems detect if a predetermined number of the lowest denomination coins are available in the change bank. For example, if nickels are the lowest denomination coins in a particular change bank, the predetermined number will typically be four. With this many nickels, change can be returned when a quarter is used to buy a five-cent item or service. When the supply of nickels is less than this predetermined amount, the system automatically switches to a "correct change only" mode in which it permits a vend only when the amount of money deposited equals the selling price of the article to be purchased. For instance, in these conventional systems a vend requiring ten-cents change is not permitted, even though the change bank contains a supply of dimes, so long as the supply of nickels is depleted, i.e., so long as the change bank does not have at least the predetermined number of nickels available.

The limitations of these conventional systems become even more apparent when more than two denominations of coins are stored in the change bank. For example, a significant number of the lowest denomination coins must be stored in the change bank to satisfy the change payback requirements of the conventional systems even when change can be made using the available larger denomination coins.

There is at least one coin handler that avoids some of the problems outlined above by sensing minimum coin levels in more than a single change tube. This handler, however, has additional deficiencies that could be improved. For example, if this handler is to return 30¢ in change, it will return dimes until the level of dimes falls below the minimum-dime level, at which point it will start to return nickels to complete the returning of change—even if there are no nickels in the nickel change tube. Thus, the customer on occasion can be short-changed using this system. Although this system does return change in many circumstances when other conventional change making systems will not, it will not always return change whenever there is some combination of coins available in the change tubes to make the desired amount of change. For instance, if quarters and dimes are available, but nickels are not, this system will not make 40¢ change even though change could be returned using four dimes. An additional disadvantage of this coin handling system is that it will return an amount of change, e.g., 30¢, which is larger than the largest denomination coin deposited, e.g., a quarter. This condition, which occurs when the handler is being misused as a change maker, is undesirable and should be prevented.

Additionally, conventional systems would be especially handicapped if the government were to introduce a coin of a denomination which is not divisible into or by the value of other coins used in making change, e.g., a two-cent coin. For example, if thirteen cents (13¢) were to be returned to a customer from a change bank containing only 2¢ coins, nickels and dimes, conventional coin systems would be unable to return change. These systems would begin change return with one dime and then be unable to complete the return of change, even though change could have been made using a nickel and four two cent coins. This situation also occurs in various foreign countries.

SUMMARY OF THE INVENTION

Among the several objects of this invention may be noted the provision of a change making system which does not enter a "correct change only" mode unless the change bank does not have available any combination of coins to make the required amount of change; the provision of such a system which compares the available coins in the change bank with the amount of change to be returned to determine if some combination of coinage is available to return the proper amount of change; the provision of such a system that remains functional with a minimum number of coins in the change bank; and the provision of such a system that is not dependent upon a coin of any particular denomination being divisible by coins of other denominations.

Briefly, the change making system of the present invention includes change storage means for storing coins of different denominations for use as change, and means for issuing coins from the storage means in change in different amounts. The change making system also includes a control system comprising coin availability determining means for determining which denominations of coins are available as change, a vend control for permitting a vend, memory means and logic means. Data representing a plurality of coin combinations are stored in the memory means, each coin combination corresponding to the coins to be returned for a particular amount of change due and a particular availability of coins in the change storage means. The logic means determines the amount of credit accumulated as a result of the deposit of money in the vendor and compares the price of a selected transaction with the accumulated credit to determine the amount of change due the customer. It also obtains from the memory means the coin combination, if any, corresponding to the amount of change due and the availability of coins in the change storage means. The logic means governs the vend control to permit a vend if the memory means contains data representing a valid coin combination for the amount of change due and the particular availiability of coins in the change storage means.

The method of the present invention comprises preselecting and storing a plurality of coin combinations. For each of a plurality of different coin availabilities of the change storage means, a plurality of coin combinations are preselected to be used in making change when the change storage means has that coin availability. Each of the coin combinations corresponds to a particular amount of change to be returned from the change storage means. The preselected coin combinations are stored in a memory. The following steps of the present method are performed for each vend: Determining the coin availability of the change storage means; computing the amount of change due the customer; accessing the memory to find a coin combination, if any, stored there corresponding to both the coin availability of the storage means and the amount of change due the customer; and issuing coins in the numbers and kinds described in said coin combination to return the amount of change due the customer.

Other objects and features will be in part apparent and in part pointed out hereinafter.

BRIEF DESCRIPTION OF THE DRAWINGS

FIGS. 10 and 10A are a chart representing the coin return information stored in a memory used in the present invention.

Corresponding reference characters indicate corresponding parts throughout the several views of the drawings.

DESCRIPTION OF THE PREFERRED EMBODIMENT

Figure 1:
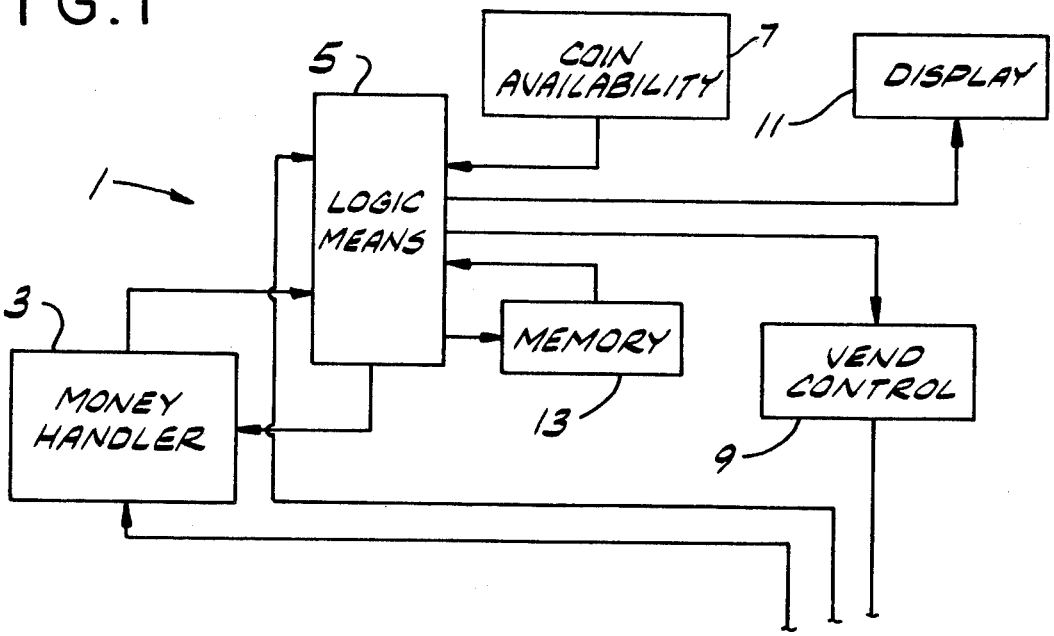
FIG. 1 is a block-diagrammatic representation of the change making system of the present invention.
Figure 2:
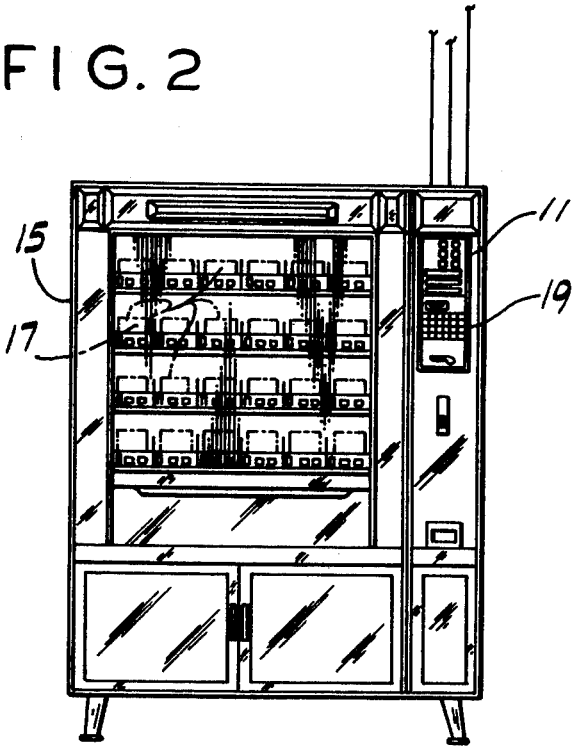
FIG. 2 is a front elevation of a vendor capable of a plurality of customer selectable transactions with which the change making system of this invention is used.

Referring now to the drawings, there is shown in FIG. 1 a change making system 1 for a money handler 3 which includes logic means 5, coin availability determining means 7, a vend control 9 for permitting a vend, a display 11 and a memory 13. The change making system is used, for example, in a vendor 15 (see FIG. 2) containing a plurality of items or transactions 17 at different prices, which items are customer selectable by means of a matrix of selection switches 19. Money handler 3 is designed to return change in amounts of 5¢, 10¢, 15¢, 20¢, . . . 95¢, although the present invention is not limited to such amounts of change. In addition and as is explained in more detail below, a vend requiring more than 20¢ change is not permitted unless a dollar has been deposited in the vendor. In this way, abuse of the vendor as a money changer is prevented.

Figure 3:
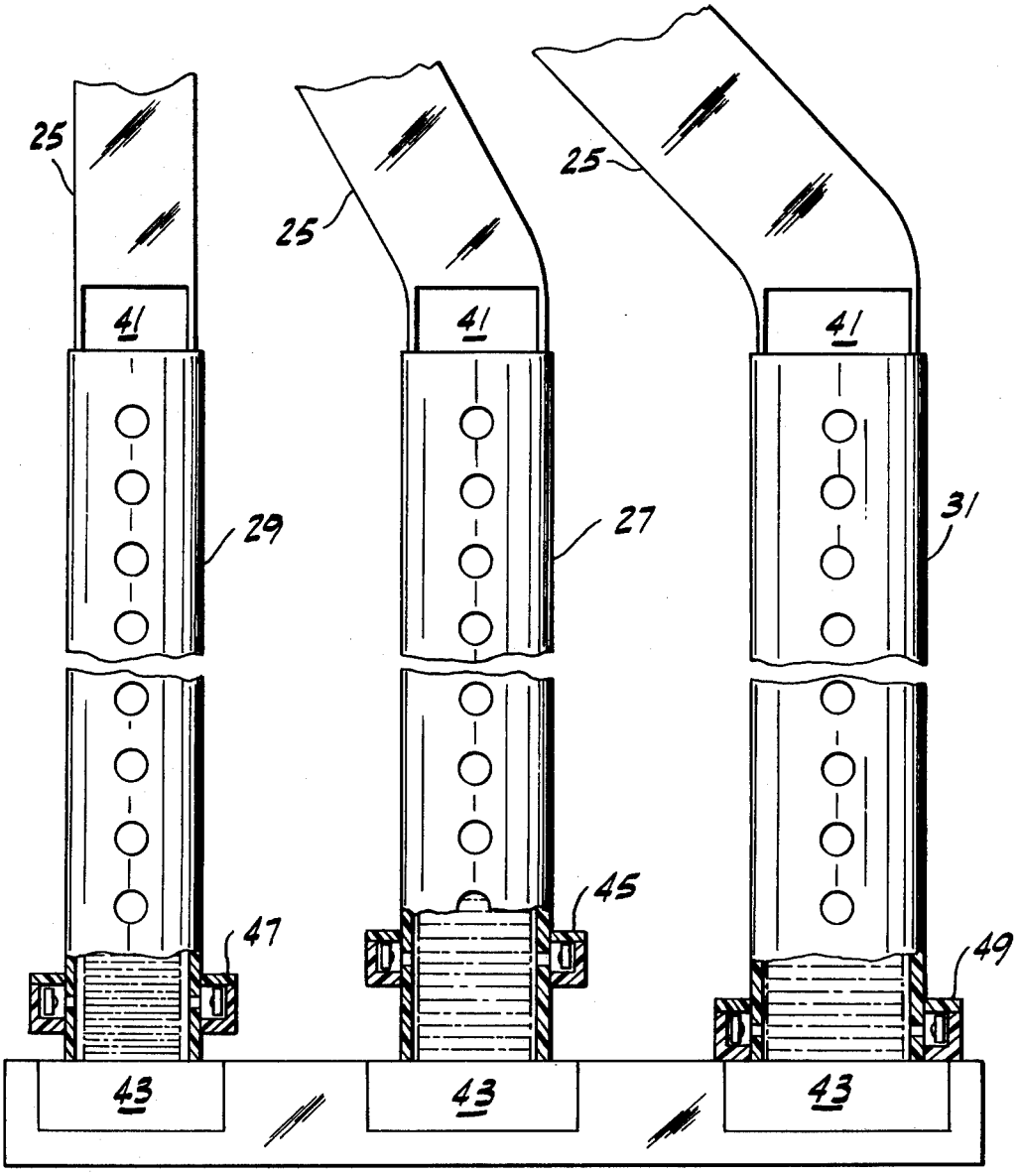
FIG. 3 is a front elevation, with parts broken away and shown in section, of a plurality of change tubes showing sensors on the change tubes used in this invention.

The money handler (see FIG. 3) comprises a coin handler (not shown) which rejects slugs and sorts and identifies in a conventional manner any valid nickels, dimes, and quarters inserted into vendor 15 into the proper one of three coin chutes, each designated by the reference numeral 25. Optionally, the coin handler may also be capable of accepting dollar coins and sorting them into a dollar coin chute (not shown) similar to the other coin chutes 25. When higher denomination items of money are to be accepted, the money handler also includes a bill validator (not shown). The nickel, dime and quarter coin chutes lead to a group of three self-replenishing change tubes, viz. a nickel change tube 27, a dime change tube 29, and a quarter change tube 31, which collectively constitute change storage means for storing coins of different denominations for use as change. Of course, this system need not have exactly three change tubes and the change tubes need not contain the above-mentioned coins. For example, a change making system for making change in penny increments would use pennies, nickels and dimes in the change tubes, and could even use the two-cent coin that has been proposed. Furthermore, such a system could even use foreign coins. Thus, it should be understood that the denominations used in this description are illustrative only.

After a coin has passed through its respective chute 25, it either falls into its coin tube (when the tube needs coins) or is deflected into a cash box (when the tube is full) by a mechanical diverter 41 or the like disposed above its tube. Of course, other means could be used to direct the coins to the tube or cash box, as required. Those described above are meant to be illustrative only. Each coin tube has a solenoid operated ejector 43, which ejects coins from that tube as needed for change. Ejectors 43 and their respective solenoids collectively constitute means for issuing coins from the change storage means in change in different amounts.

Coin availability determining means 7 includes opto-electronic sensors 45, 47 and 49 disposed on the nickel, dime and quarter change tubes respectively for determining whether the change tubes contain coins of the different denominations available as change, that is, for determining which denominations of coins are available as change. Specifically, these sensors determine if the nickel tube contains at least nine nickels, if the dime tube contains at least nine dimes, and if the quarter tubes contain at least three quarters. A denomination of coin is available as change if its respective sensor senses the presence of coins in the corresponding change tube and is not available as change if the level of coins in the corresponding tube falls below that tube's sensor. Thus, coin availability determining means 7 is means for determining whether the change storage means contains coins of different denominations available as change. Of course, the levels of coins that sensors 45, 47 and 49 sense may be different than those described above if desired. There are both advantages and disadvantages to this, however. Increasing the level of the nickel sensor to the point where it senses eleven nickels instead of nine, for example, would enable change to be made when 55¢ change is due even when quarters and dimes are not available as change, but it would also result in nickels not being available for use in making change when nine or ten nickels (or less) are contained in the nickel tube. Thus, it should be understood that the placement of sensors 45, 47 and 49 is a compromise between the placement that permits change to be made in the maximum number of different ways and the placement that permits change to be made with the least possible number of coins in each of the coin tubes. Other placements of the sensors are, of course, permissible and the above placements are intended to be illustrative only.

The coin storage means has a plurality of different coin availabilities. For example, if nickels, dimes and quarters are all available for use as change, that is one coin availability, and if only dimes and quarters are available that is another coin availability. The eight possible coin availabilities of a system having single coin tubes for nickels, dimes and quarters are listed below:

1. Nickels, dimes and quarters all available.
2. Nickels and dimes available, but not quarters.
3. Nickels and quarters available, but not dimes.
4. Nickels available, but not dimes or quarters.
5. Dimes and quarters avilable, but not nickels.
6. Dimes available, but not nickels or quarters.
7. Quarters available, but not nickels or dimes.

8. Neither nickels, nor dimes nor quarters available. Increasing the number of coin tubes and denominations would, of course, correspondingly increase the number of possible different coin availabilities.

Figure 4:
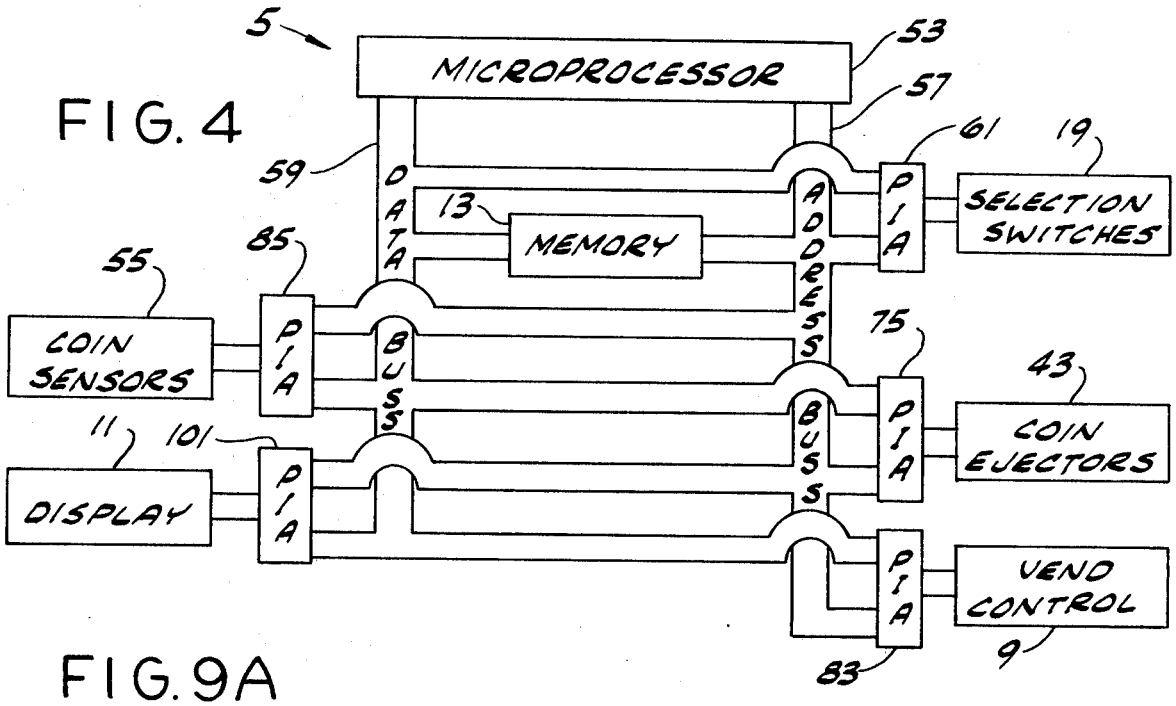
FIG. 4 is a block diagram of the circuitry of this invention.

Logic means 5 determines the amount of credit accumulated as a result of the deposit of money in the vendor, compares the price of a selected transaction with the accumulated credit to determine the amount of change due the customer and governs the vend control to permit a vend if any combination of the coins available in the change storage means equals the amount of change due. Of course, logic means 5 could comprise a number of circuits each containing many discrete components, but applicant prefers to use a microprocessor 53 (FIG. 4) suitably programmed to perform the required functions. Thus, microprocessor 53 constitutes logic means 5.

The microprocessor is a Motorola M6800-type which addresses its peripherals, i.e., selection switch matrix 19, coin ejectors 43, vend control 9, display 11 and a plurality of coin sensors 55 which includes coin sensors 45, 47, and 49 over an address bus 57. Data is transmitted between the peripherals and the microprocessor over a data bus 59. Each peripheral has an appropriate number of peripheral interface adapters (PIAs), interconnected between it and the address bus and between it and the data bus. Memory 13 is directly connected to the address and data buses. For further information concerning the M6800 microprocessor and compatible hardward, see *M6800 Microcomputer System Design Data* from Motorola, Inc. (1976).

Memory 13 includes both RAM and ROM sections. The RAM section of the memory is used to temporarily store the customer's accumulated credit and in general is used as a scratch pad for the microprocessor while it makes its various computations. The ROM section is where the program for the microprocessor as well as data representing a plurality of coin combinations are stored. Each coin combination describes the numbers and kinds of coins to be used to make a particular amount of change given a particular availability of coins in the change tubes. For example, the coin combination stored in memory for returning 40¢ in change when the change storage means has the fifth coin availability listed above (dimes and quarters available, but no nickels) is four dimes. For certain amounts of change and coin availabilities of the change storage means there are no valid coin combinations for returning change. For example, 45¢ change cannot be returned when only dimes are available.

Memory 13 has a set of memory locations in ROM for each of the different coin availabilities and each such set includes at least one location for coin data (i.e., coin combinations) for each possible amount of change from 5¢ to 95¢. Since there are eight possible coin availabilities and nineteen possible amounts of change for each, there are a total of 152 memory locations for the storage of coin data. The data stored in these locations is shown in chart form in FIGS. 10 and 10A. In this chart the abbreviations Q, D and N are used for quarter, dime and nickel, respectively. Thus, the coin combination 3Q-2D, for example, stands for three quarters and two dimes to be returned in change. A blank space in the chart indicates that there is no coin combination for the particular amount of change and coin availability corresponding to that location. For example, there is no possible coin combination for making 95¢ change when the change storage means has only nickels available, and therefore that location in the chart is blank. Note that although the particular coin combinations shown in Figs. 10 and 10A are selected to give a least number of coins during change making other criteria for selecting the coin combinations could be used. For example, in an area where dimes are scarce, nickels could be used instead of dimes in the coin combinations whenever possible.

Figure 5:
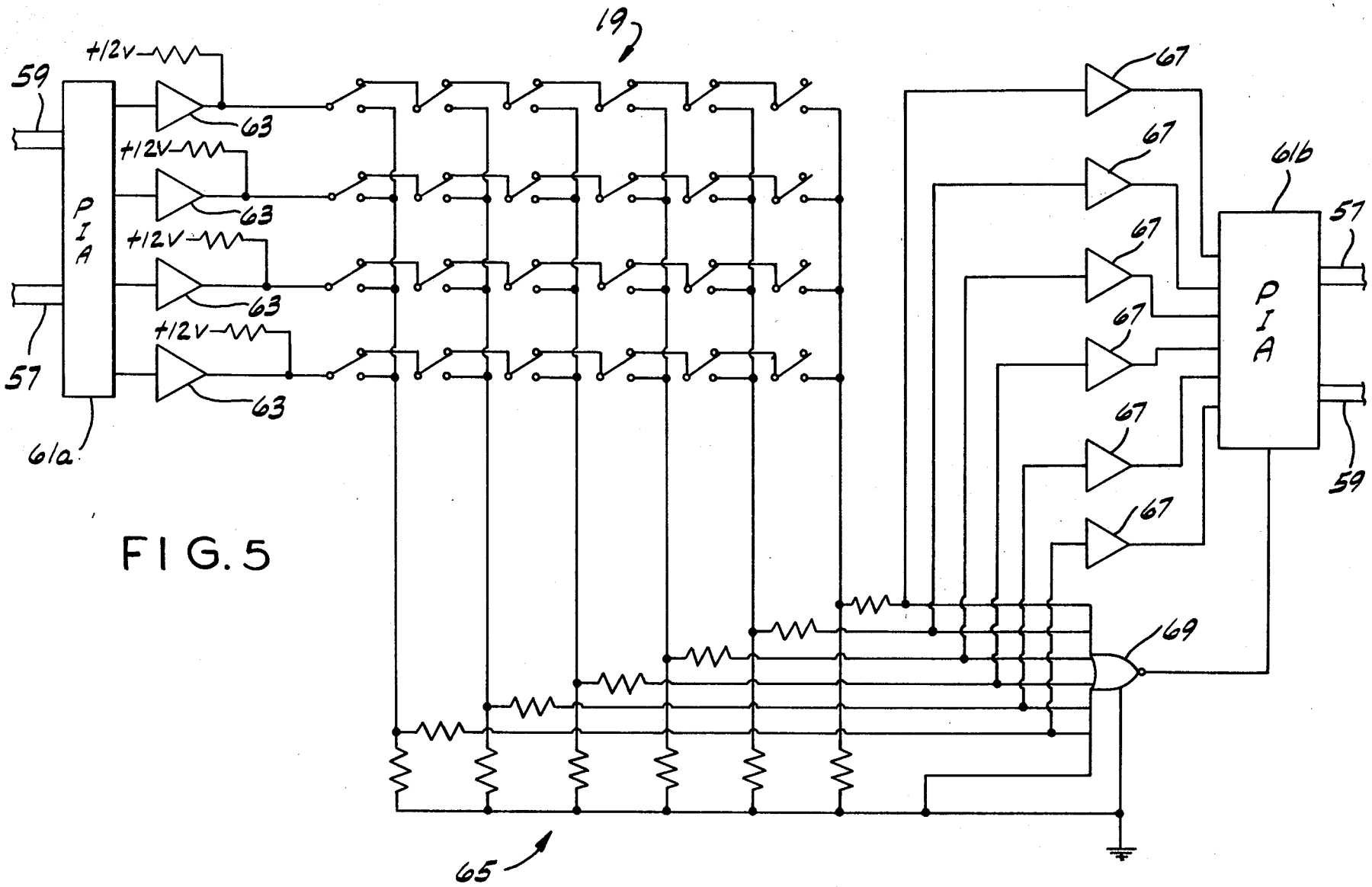
FIG. 5, is a circuit diagram of the selection switch circuitry of this invention.

Referring to the peripherals, selection switch matrix 9 is schematically shown in FIG. 5. Basically it is four-row, six-column matrix of switches, each row and each column of which is connected to a PIA. In particular, each row of switches is connected to a PIA 61*a* through one of four buffers 63. Each column is connected through a voltage divider indicated generally at 65 and one of a group of six buffers 67 to a PIA 61*b*. The columns are also connected through voltage divider 65 to a NOR gate 69 whose output is connected to one of the interrupt pins of PIA 61*b*.

Figure 6:
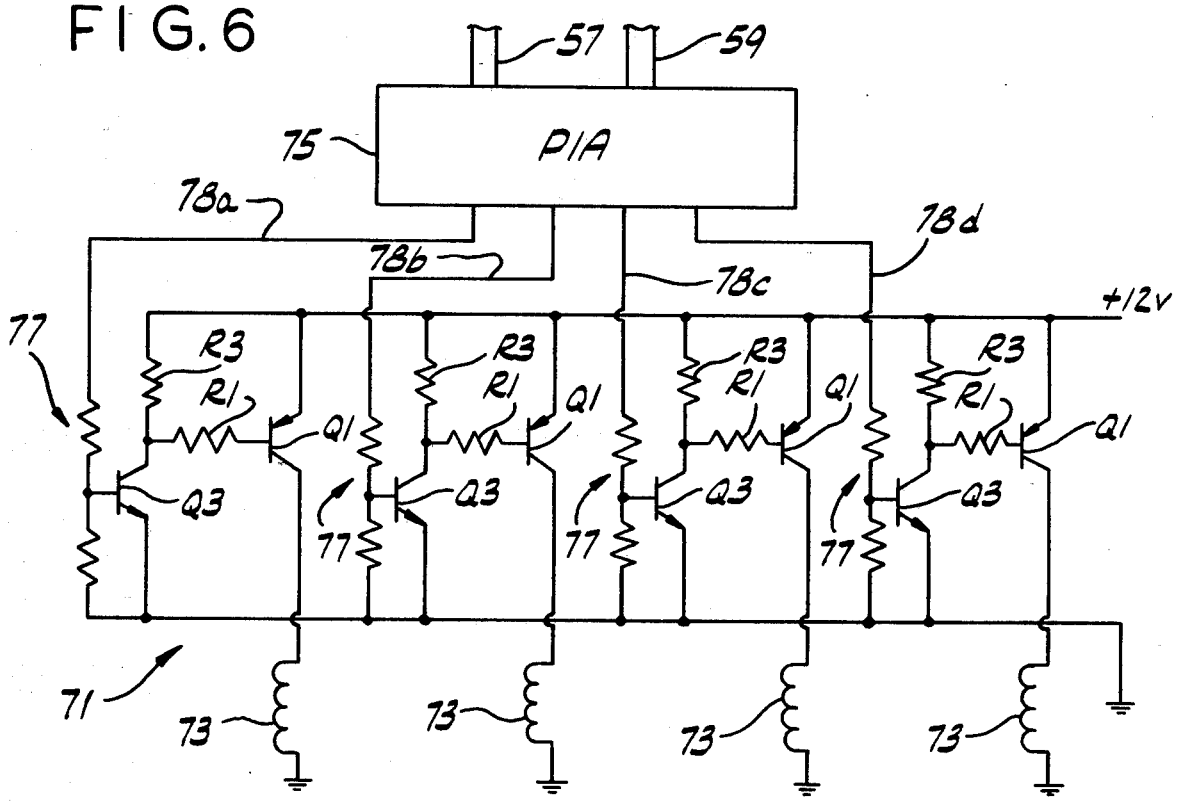
FIG. 6.is a circuit diagram of circuitry used for ejecting coins from the change tubes in this invention.

The circuitry for actuating the change tube ejectors is shown generally at 71 (FIG. 6) and comprises four solenoids 73, four PNP transistors Q1, four NPN transistors Q3 and a PIA 75. From left to right, solenoids 73 cause nickels, dimes, quarters and dollar-coins, respectively, to be ejected. Each solenoid is connected between ground and the collector of one of transistors Q1. The emitter of each transistor Q1 is connected to a +12 V source while the base of each is connected through one of a group of four resistors Rl to the collector of its respective transistor Q3. The collector of each transistor Q3 is connected through one of a group of four resistors R3 to the +12 V source, each emitter s connected to ground, and each base is connected through a voltage divider indicated generally at 77 to PIA 75. The actual return of change from the change tubes is accomplished as follows: If a dime is to be returned in change, the microprocessor causes a line 78*b* (FIG. 6) to go High. This causes the second transistor Q3 from the left to conduct thereby throwing its associated transistor Q1 into conduction. This energizes the second solenoid 73 from the left causing ejector 43 on dime tube 29 to eject one dime. Nickels are similarly ejected by the microprocessor causing a line 78*a* of PIA 75 to go High, thereby energizing the leftmost solenoid 73. Quarters are ejected by a line 78*c* going High, which causes the energization of the second from the right solenoid 73.

Figure 7:
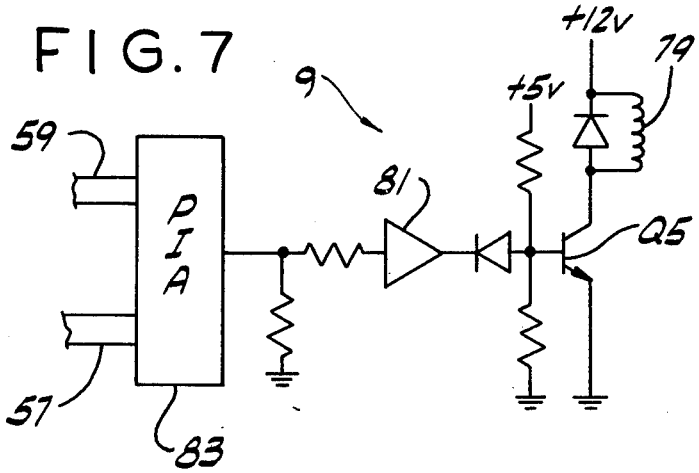
FIG. 7 is a circuit diagram of a vend control of this invention.

Vend control 9 is a relay which when actuated permits the vend to proceed by, for example, supplying power to the vending machine. Of course, vend control 9 need not be a relay; any apparatus under the control of logic means 5 may be used. The coil of the vend control relay is shown at 79 (FIG. 7). This coil is connected between a +12 V source and the collector of a NPN transistor Q5, the emitter of which is connected to ground and the base of which is connected through a buffer 81 to a PIA 83.

Figure 8:
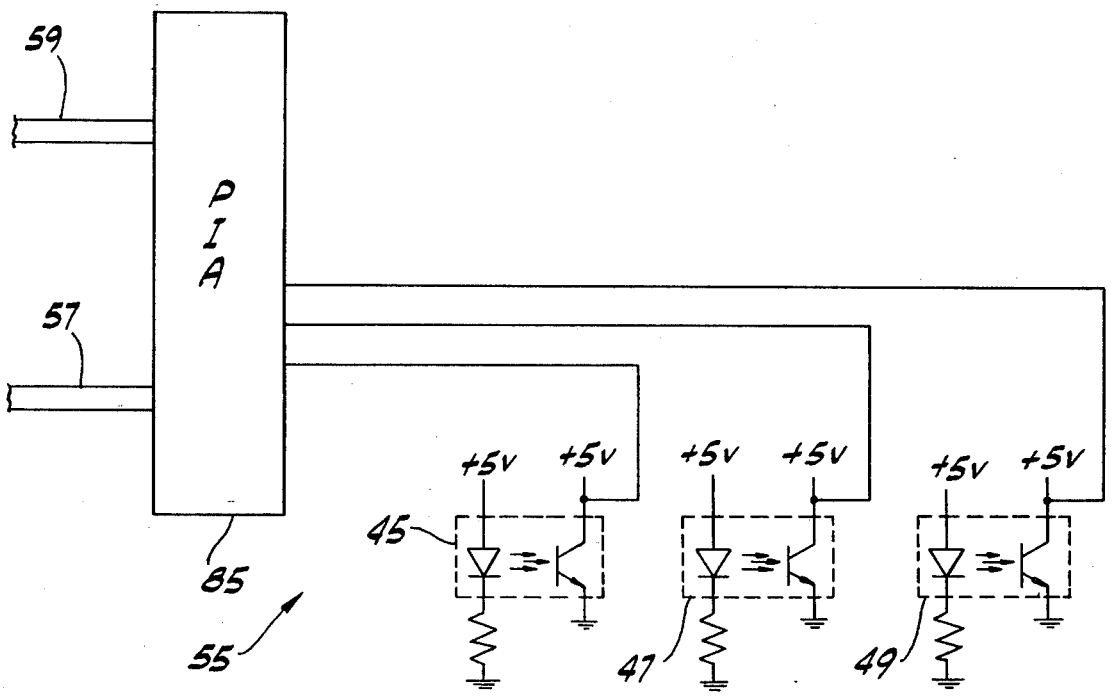
FIG. 8 is a circuit diagram of the coin sensing circuitry of the present invention.

Coin sensors 55 are shown in detail on FIG. 8. Each consists of a photodiode-phototransistor package with the collector of the phototransistor (which is of the NPN type) connected to a PIA 85. When the light path between a photodiode and its respective phototransistor is blocked, the collector of that phototransistor goes High (i.e., 5 Volts) and consequently the corresponding pin of PIA 85 also goes High.

The flowcharts for the microprocessor are shown in FIGS. 9A–9D. With these flowcharts one of ordinary skill in the art can easily write a program corresponding thereto in the language of the particular microprocessor being used. It should also be understood that when the microprocessor also governs other functions of the vendor besides change making, these flowcharts are only a part of the complete flowchart used in programming the microprocessor.

Figure 9A:
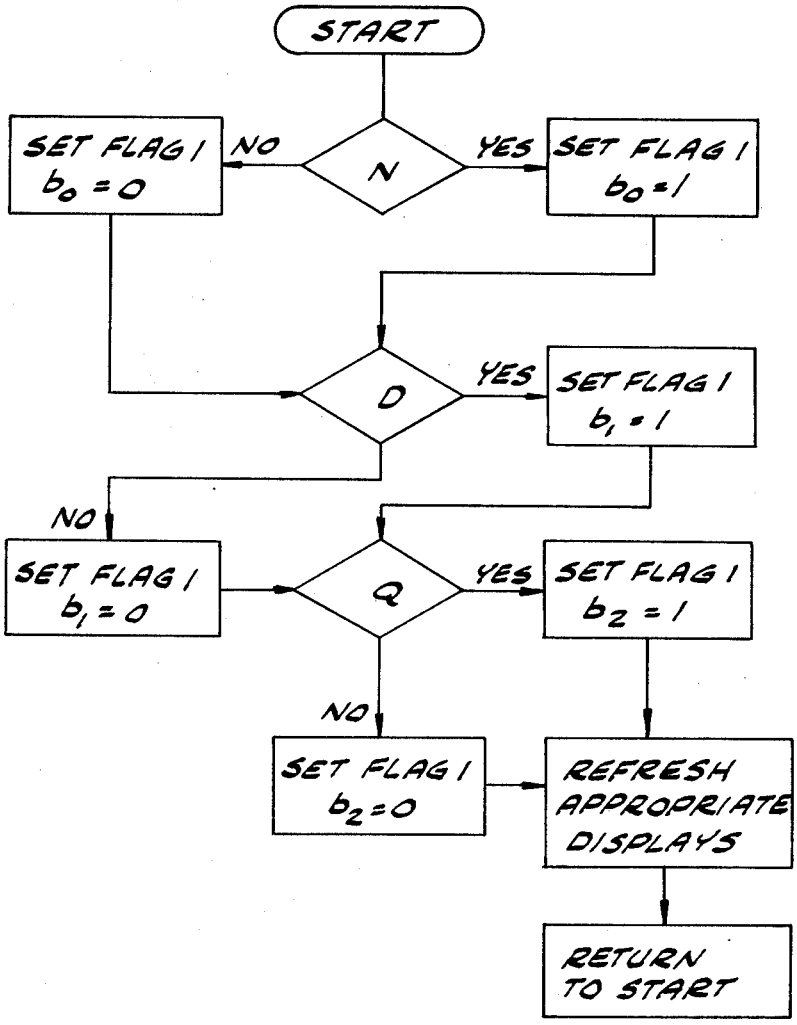
FIGS. 9A–9D are the flowcharts for a microprocessor used in this invention.

The operation of the change making system is as follows:

Prior to the selection of a transaction or the depositing of money into the vendor by a customer, the microprocessor is in a standby loop in which it checks the coin availability in the change tubes. The flowchart for this loop is shown in FIG. 9A. Of course, if the microprocessor controls other functions of the vendor the standby loop will contain many additional steps not shown in FIG. 9A. The first step of the standby loop is to determine if at least nine (or some other predetermined number) nickels are present in the nickel change tube. This is signified by the symbol "N" on the flowcharts. The microprocessor makes this determination by checking the collector voltage of sensor 45. If that voltage is High, the nickel tube contains at least nine nickels. This information is transferred by means of PIA 85 and the data bus to the microprocessor. If the voltage is High, the microprocessor sets the zero bit, $b_0$, of a buffer FLAG1 equal to 1. If tube 27 does not contain at least nine nickels, the microprocessor sets $b_0$ of FLAG1 equal to 0.

Having recorded the status of the nickel change tube, microprocessor 53 checks the status of the dime change tube, i.e., performs the test "D" on the flowchart, to determine if there are at least nine (or some other predetermined number) dimes present in tube 29. That is, it addresses PIA 85 to determine if the collector of sensor 47 is High. If so, the microprocessor sets $b_1$ of FLAG1 equal to 1. If not, $b_1$ is set equal to 0.

After testing for dimes, the microprocessor determines if there are at least three (or some other predetermined number) quarters present in change tube 31 by using PIA 85 to test sensor 49. If there are, it sets $b_2$ of FLAG1 equal to 1. If not, $b_2$ is set equal to 0. After setting all these bits, the microprocessor returns to the start of the standby loop to repeat the process. Thus, information representing the coin availability in the change tubes is at all times stored in FLAG1.

Figure 9B:
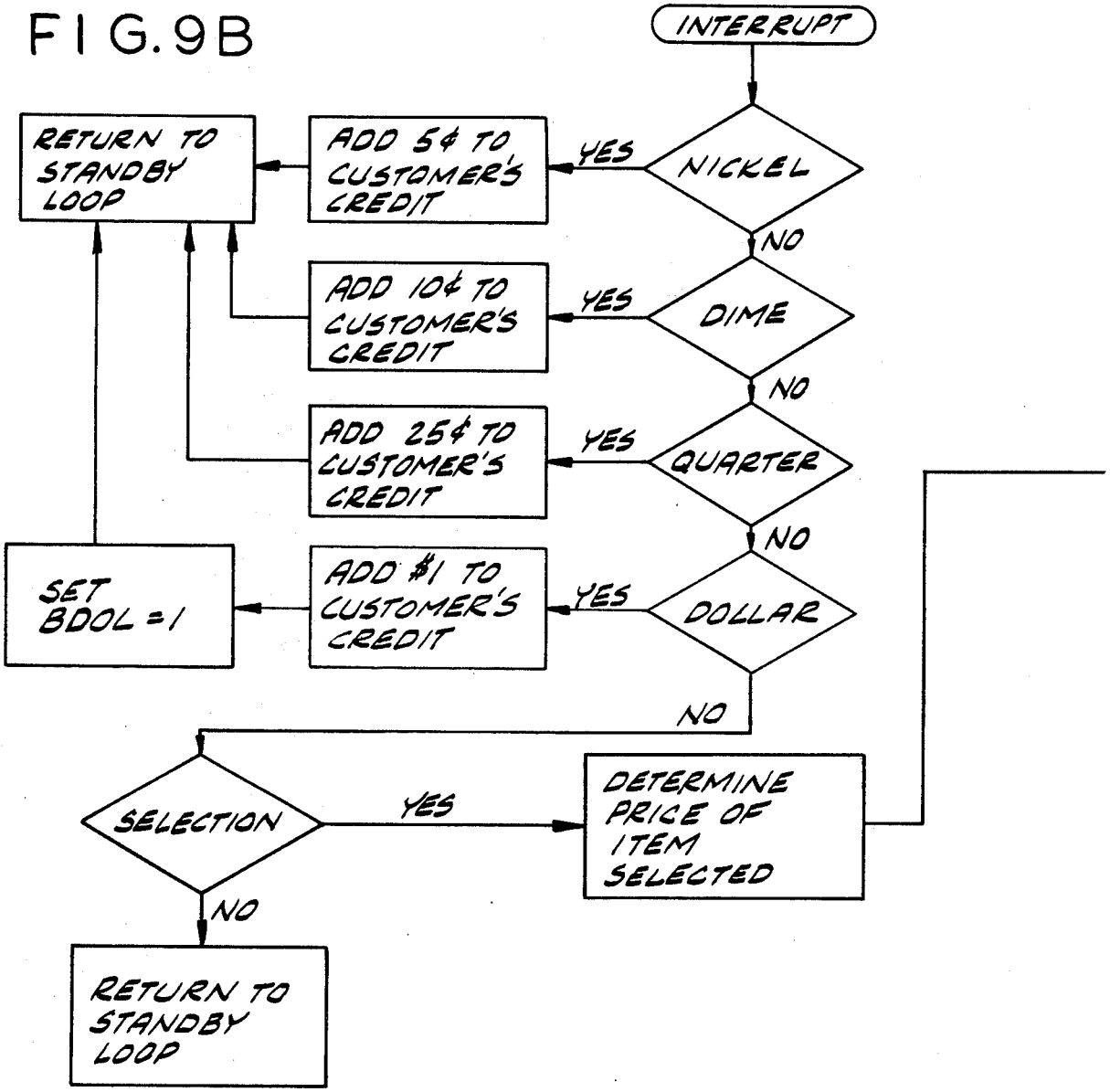
Figure 9C:
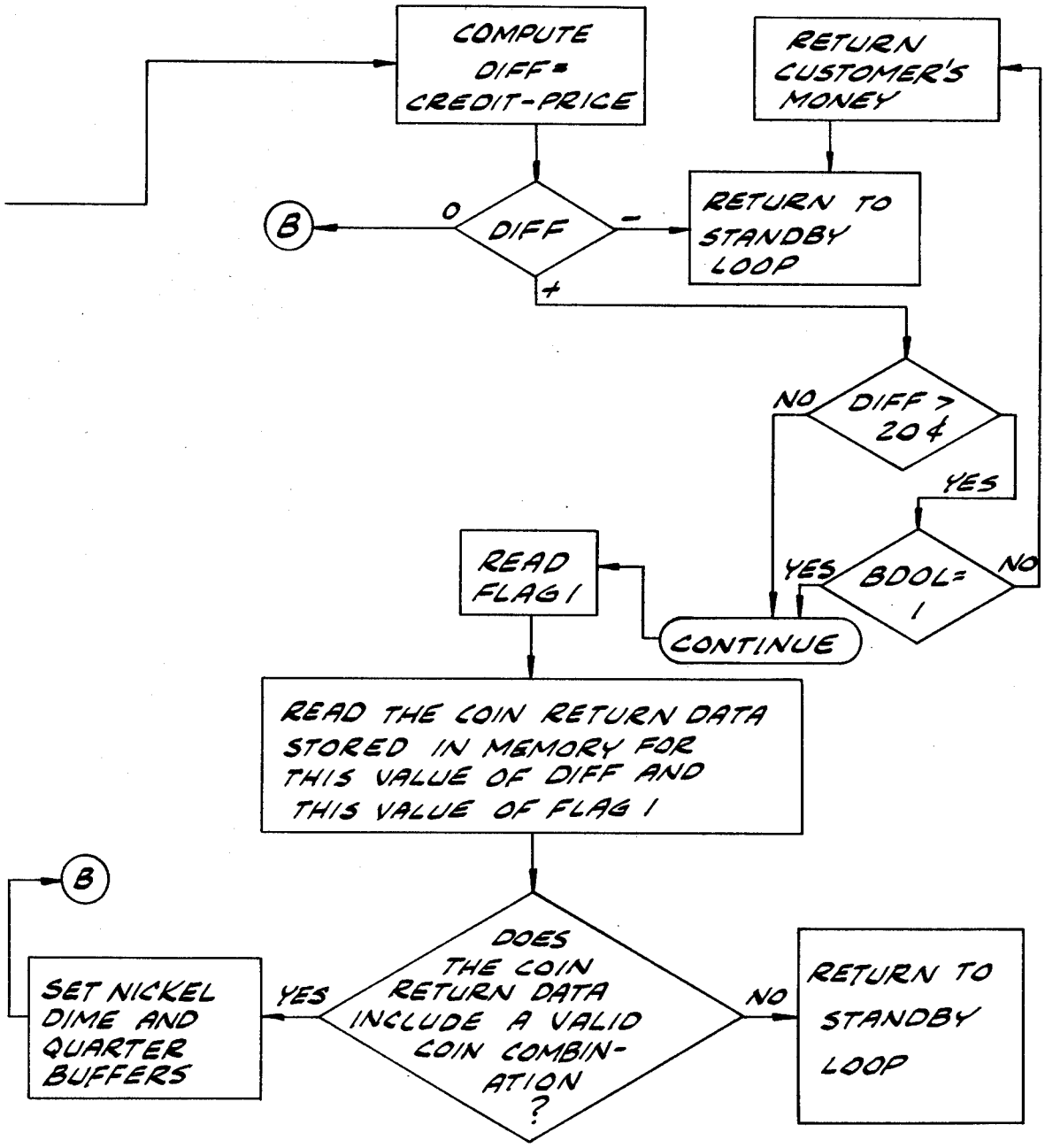
Figure 9D:
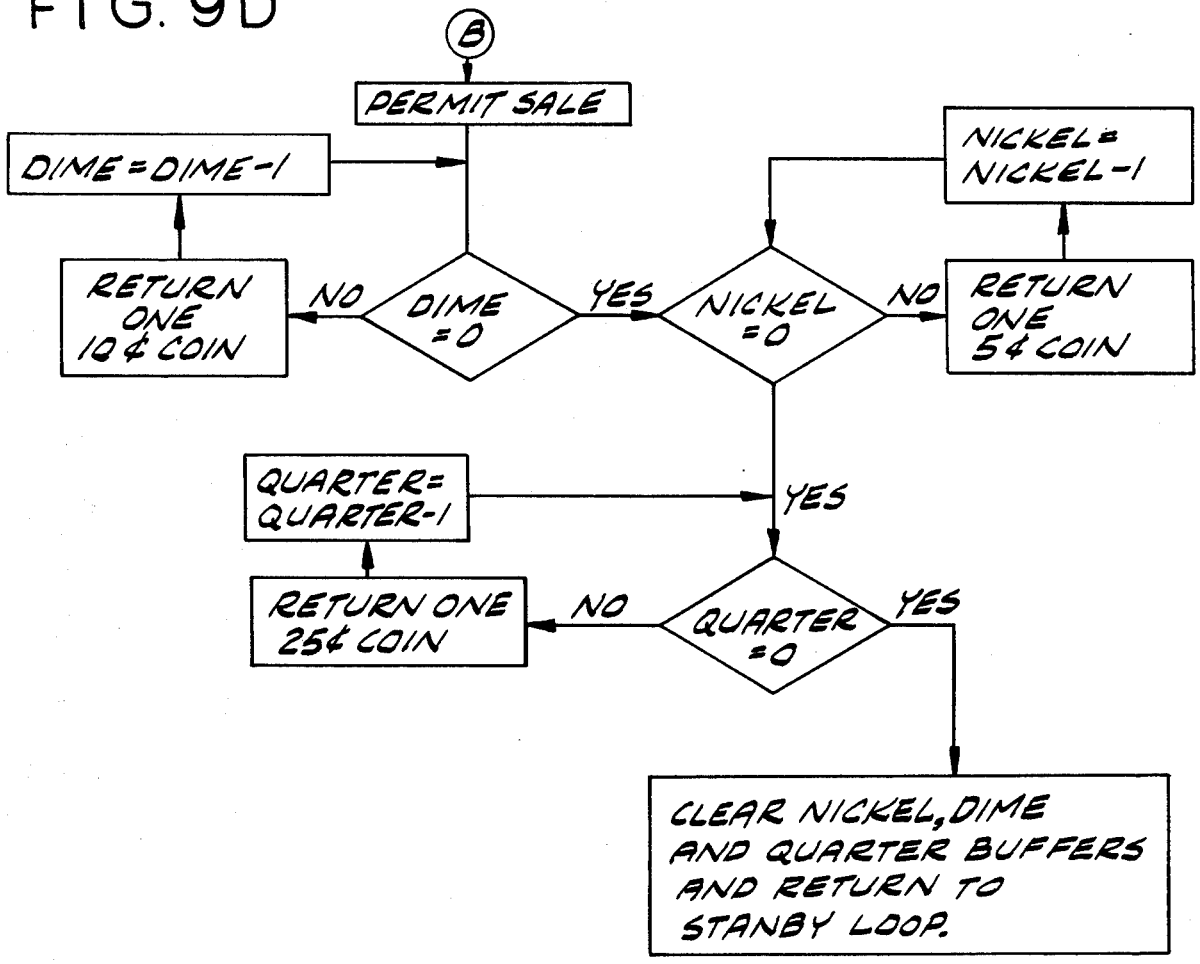

When a customer deposits a coin in a vendor having change making system 1, that coin is sensed by conventional coin sensors, which are included in coin sensors 55 but otherwise not separately shown, and the microprocessor initiates the interrupt subroutine shown on FIGS. 9B–9D. In the interrupt sequence the microprocessor first polls PIA 85 to determine if a nickel generated the interrupt (this is shown by the word "NICKEL" in the first decision box of FIG. 9B). If a nickel did generate the interrupt, the microprocessor adds 5¢ to the customer's accumulated credit, which previously was zero, and stores this figure in memory. The microprocessor then returns to the standby loop.

If the item of money deposited was not a nickel, the microprocessor polls PIA 85 to see if it was a dime. This is indicated by the word "DIME" in the second decision box of the interrupt sequence. If so, 10¢ is added to the customer's accumulated credit and the microprocessor returns to the standby loop. If not, the microprocessor goes on to check for the deposit of a quarter. The above process continues through quarters and dollar coins, the accumulated credit figure being updated in each case. In all instances, after updating the customer's accumulated credit, the microprocessor returns to its standby loop. In addition, when a dollar coin is deposited, the microprocessor sets a buffer BDOL equal to 1. As is explained below, this buffer is used to prevent misuse of the money handler as a moneychanger.

If the interrupt was not generated by the deposit of an item of money, the microprocessor, after fruitlessly checking to see if a dollar-coin was the cause of the interrupt, checks to determine if it was a selection interrupt. This in indicated by the decision box containing the word "SELECTION" on FIG. 9B. A selection interrupt is generated by the customer pressing one of the selection switches in matrix 19. Referring to FIG. 5, the closing of any one of the selection switches completes a circuit between one of the 12 V sources adjacent buffers 63 and voltage divider 65. This causes one of the inputs of NOR gate 69 to go High and thus its output to go Low. This output is supplied to an interrupt pin of PIA **61*b***, which PIA has been programmed to initiate an interrupt sequence upon the voltage at said interrupt pin going Low. For more information about this, the reader is referred to the aforementioned Motorola publication.

If the interrupt is a selection interrupt, caused for example by the customer pressing the second selection switch in the third row, the microprocessor reads the selection switches to see which one was pressed. This is accomplished by sequentially strobing the rows of the matrix through PIA **61*a* and buffers 63 while reading the voltage levels on the columns through buffers 67 and PIA 61*b*. Since each selection switch is uniquely determined once its row and column have been specified, the microprocessor detects and identifies the closed switch by the High output of one of buffers 67 in response to an input into one of the rows by PIA 61*a***. Once the closed selection switch is identified, this information is stored in a buffer in memory. The microprocessor then addresses the location in memory where the price of the transaction associated with the closed selection switch is stored.

Once the price of the selected transaction is determined, the difference between the customer's accumulated credit and the price is computed by the microprocessor (see FIG. 9C). If this difference is negative, i.e., if the price exceeds the accumulated credit, the microprocessor returns to the standby loop since the customer has not deposited enough money to purchase the desired transaction. If the difference equals zero, on the other hand, the customer has inserted the correct change for the transaction selected, so the microprocessor branches to a point B in the program. From point B (FIG. 9D), the microprocessor first permits the vend by causing the output of PIA 83 which is connected to buffer 81 (FIG. 7) to go High, thereby causing transistor Q5 to conduct which in turn energizes coil 79 of the vend relay. Next the microprocessor returns any change due the customer. In this case, of course, the customer is due no change. Then the microprocessor clears, i.e., erases, the accumulated credit figure and some buffers, described below, in memory and returns to the standby loop.

If the difference between the customer's accumulated credit and the price of the selected transaction is positive rather than negative or zero, the customer has inserted more money than required. The microprocessor tests this difference to determine if an attempt is being made to misuse the money handler as a changer by first testing to see if the difference is greater than 20¢. If it is not, the money handler is not being misused and the microprocessor proceeds to go through a coin return subroutine. If the difference is greater than 20¢, microprocessor 53 reads buffer BDOL to see if the customer has deposited a dollar. If the customer has deposited a dollar, he is not attempting to misuse the money handler, and the microprocessor again proceeds through the coin return subroutine. If the customer has not deposited a dollar, however, he is attempting to get back twenty-five or more cents in change when the largest denomination coin he has deposited is no larger than a quarter. This is a misuse of the money handler which is not allowed. In these circumstances the microprocessor returns the customers money by actuating the appropriate ejectors 43, and returns to the standby loop.

Next, if the money handler is not being misused, microprocessor 53 reads FLAG1 to determine the coin availability in the change bank. Thereupon, it reads the coin return data (i.e., the data represented in the chart on FIGS. 10 and 10A) corresponding to the amount of change due (i.e., DIFF) and the particular coin availability in the change storage means (which is represented by the data in FLAG1).

The remaining steps the microprocessor takes after reading the coin return data (which steps are represented by the rest of the flowchart shown on FIGS. 9C and 9D) can best be explained by examples. In these examples the contents of the change bank are given in terms of what the coin tube sensors can measure, i.e., what coins are available as change, rather than in terms of how many coins these tubes actually contain. In considering these examples it should also be appreciated that applicant's system is not limited to making a maximum of 95¢ change or any other amount of change.

As a first example, the change bank has nickels, dimes and quarters available and the customer is due 95¢ change. Under these conditions, the microprocessor retrieves the coin combination corresponding to this amount of change and this coin availability from memory, i.e., three quarters and two dimes, and sets a buffer QUARTER equal to three to indicate that three quarters are to be returned in change and a buffer DIME equal to two to indicate that two dimes are to be returned in change. After setting the buffers, microprocessor 53 goes to program point B (see FIG. 9D) which is the beginning of the vend and change return subroutine. The first step in the vend and change return subroutine is acutation of the vend relay, which is described above. Next the microprocessor checks the buffer DIME to see if any dimes are to be returned in change. DIME does not equal zero at this point (it equals two) so microprocessor 53 returns one dime in change (actual return of coins is explained in detail above) and decrements DIME by one. The microprocessor then rechecks DIME to see if it equals zero. It does not, so another dime, the second, is returned in change and DIME=0, is again decremented by one. Again, the microprocessor tests DIME to see if it equals zero. At this point DIME=0, so the microprocessor moves on to test a buffer NICKEL to see if any nickels are to be returned in change. In this example, nickels are not part of the coin combination, so the contents of NICKEL is zero. Upon finding that NICKEL=0, microprocessor 53 checks QUARTER for zero contents. At this point QUARTER=3, and the microprocessor as a result causes one quarter to be returned in change, decrements QUARTER by one and reexamines QUARTER. Now QUARTER=2, so the microprocessor causes another quarter to be returned in change, and again decrements QUARTER by one and then checks it for zero contents. Since QUARTER=1 at this point, the microprocessor goes through this loop one more time, returning the third quarter in change and decrementing QUARTER to zero. After finding that QUARTER now equals zero, the microprocessor makes sure that the coin return buffers NICKEL, DIME and QUARTER are clear and then returns to the standby loop.

For a second example, the customer has inserted a dollar to buy a 45¢ transaction and the change bank has only nickels available. When the microprocessor reads the coin return data from the memory under these conditions, it finds that there is no coin combination for returning this amount of change (55¢) with the coins available, i.e., there is no valid coin combination. The microprocessor thereupon returns to the standby loop to await further customer instructions.

In view of the above it can be seen that the method of the present invention includes preselecting, for each of a plurality of different coin availabilities of the change storage means, a plurality of coin combinations to be used in making change when the change storage means has that particular coin availability, each of said coin combinations corresponding to a particular amount of change to be returned from the change storage means; storing the preselected coin combinations in a memory; and performing the following steps for each vend: Determining the coin availability; computing the amount of change due the customer; accessing the memory to find a coin combination, if any, stored there corresponding to both the coin availability in the storage means and the amount of change due the customer; and issuing coins in the numbers and kinds described in said coin combination to return the amount of change due the customer.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A change making system for a money handler in a vendor capable of a plurality of customer selectable transactions, having means for identifying the denominations of items of money deposited in the vendor, said system comprising:

change storage means for storing coins of different denominations for use as change;

means for issuing coins from the storage means in change in different amounts;

coin availability determining means for determining which denominations of coins are available as change;

a vend control for permitting a vend;

memory means for storing data representing a plurality of coin combinations, each coin combination corresponding to the coins to be returned for a particular amount of change due and a particular availability of coins in the change storage means; and logic means for determining the amount of credit accumulated as a result of the deposit of money in the vendor, for comparing the price of a selected transaction with the accumulated credit to determine the amount of change due the customer, for obtaining from the memory means the coin combination, if any, corresponding to the amount of change due and the availability of coins in the change storage means, and for governing the vend control to permit a vend if the memory means contains data representing a valid coin combination for said amount of change due and the particular availability of coins in the change storage means.

2. A change making system as set forth in claim 1 wherein the memory includes a plurality of memory locations for each of a plurality of possible amounts of change, in which locations are stored coin combinations equaling said amount of change for different amounts and types of available coins, said logic means being responsive to the coin availability of the storage means and to the particular amount of change due to obtain a coin combination from the particular location in the memory means corresponding to said coin availability and said particular amount of change due.

3. A change making system as set forth in claim 1 wherein the change storage means includes at least one change tube for each different denomination of coin used as change.

4. A change making system as set forth in claim 3 wherein each of said change tubes has a coin ejector associated therewith for ejecting coins one at a time from its respective change tube.

5. A change making system as set forth in claim 3 wherein the change storage means includes a first change tube for storing coins of a first denomination, a second change tube for storing coins of a second denomination, and a third change tube for storing coins of a third denomination.

6. A change making system as set forth in claim 5 wherein the coin availability determining means includes a first optoelectronic sensor disposed on the first change tube at a position where it senses if the first change tube contains at least a first predetermined number of coins, a second optoelectronic sensor disposed on the second change tube at a position where it senses if the second change tube contains at least a second predetermined number of coins, and a third optoelectronic sensor disposed on the third change tube at a position where it senses if the third change tube contains at least a third predetermined number of coins.

7. A change making system as set forth in claim 1 wherein the change storage means includes a plurality of change tubes and wherein the coin availability determining means includes a plurality of optoelectronic sensors, each change tube having an optoelectronic sensor disposed thereon at a position where said sensor senses if its change tube contains at least a predetermined number of coins of that denomination.

8. A control system for a money handler in a vendor having means for identifying the denominations of items of money deposited in the vendor, change storage means for storing coins of different denominations for use as change, and means for issuing coins from the storage means in change, said control system comprising:

means for determining which denominations of coins are available as change;

a memory for storing data representing a plurality of coin combinations, each coin combination representing the numbers and denominations of coins to be returned for a particular amount of change due and a particular availability of coins in the change storage means; and logic means for obtaining from the memory data representing the coin combination, if any, corresponding to the amount of change due the customer and the availability of coins in the change storage means and to supply a vend signal to the vendor if the data from the memory represents a valid coin combination.

9. A control system as set forth in claim 8 wherein the logic means includes means for supplying signals to the coin issuing means to control the numbers and denominations of coins returned in change in accordance with the coin combination data obtained from the memory.

10. A control system as set forth in claim 8 wherein the memory includes a plurality of memory locations for each of a plurality of possible amounts of change, in which locations are stored coin combinations equaling said amount of change for different amounts and types of available coins, said logic means being responsive to the coin availability of the storage means and to the particular amount of change due to obtain a coin combination from the particular loction in the memory corresponding to said coin availability and said particular amount of change due.

11. A control system as set forth in claim 8 wherein the change storage means includes a first change tube for holding coins of a first predetermined denomination, a second change tube for holding coins of a second predetermined denomination, and a third change tube for holding coins of a third predetermined denomination, and wherein the coin availability determining means includes a first optoelectronic sensor disposed on the first change tube at a position where it senses if the first change tube contains at least a first predetermined number of coins, a second optoelectronic sensor disposed on the second change tube at a position where it senses if the second change tube contains at least a second predetermined number of coins, and a third optoelectronic sensor disposed on the third change tube at a position where it senses if the third change tube contains at least a third predetermined number of coins.

12. A control system as set forth in claim 8 wherein the change storage means includes a plurality of change tubes for holding coins of particular denominations and wherein the coin availability determining means includes a plurality of optoelectronic sensors, each change tube having an optoelectronic sensor disposed thereon at a position where said sensor senses if its change tube contains at least a predetermined number of coins of that denomination.

13. The method of change making for a money handler in a vendor capable of a plurality of customer selectable transactions, said money handler having change storage means for storing coins of various denominations for use as change, said method comprising:

preselecting, for each of a plurality of different coin availabilities of the change storage means, a plurality of coin combinations to be used in making change when the change storage means has that particular coin availability, each of said coin combinations corresponding to a particular amount of change to be returned from the change storage means;

storing the preselected coin combinations in a memory; and performing the following steps for each vend:

determining the coin availability in the change storage means;

computing the amount of change due the customer;

accessing the memory to find a coin combination, if any, stored there corresponding to the coin availability in the storage means and the amount of change due the customer; and issuing coins in the numbers and kinds described in said coin combination to return the amount of change due the customer.

14. The method as set forth in claim 13 wherein the preselected coin combinations to be used in making change are selected to provide the least possible number of coins in change to the customer given the availability of coins in the change storage means.

* * * * *